US011476028B2

(12) United States Patent
Garrard et al.

(10) Patent No.: US 11,476,028 B2
(45) Date of Patent: Oct. 18, 2022

(54) 219-1040 METHOD FOR DRIVING INDUCTIVE PEAK AND HOLD LOADS AT REDUCED POWER

(71) Applicant: Ford Global Technologies, LLC, Dearborn, MI (US)

(72) Inventors: Mike Garrard, Chelmsford (GB); Jonathan Thombs, Danbury (GB)

(73) Assignee: Ford Global Technologies, LLC, Dearborn, MI (US)

( * ) Notice: Subject to any disclaimer, the term of this patent is extended or adjusted under 35 U.S.C. 154(b) by 127 days.

(21) Appl. No.: 17/144,909

(22) Filed: Jan. 8, 2021

(65) Prior Publication Data

US 2021/0217549 A1 Jul. 15, 2021

(30) Foreign Application Priority Data

Jan. 10, 2020 (GB) ..... 2000366

(51) Int. Cl.
*H01F 7/18* (2006.01)
*F02M 47/02* (2006.01)

(52) U.S. Cl.
CPC ..... *H01F 7/1844* (2013.01); *F02M 47/027* (2013.01); *H01F 7/1811* (2013.01); *H01F 2007/185* (2013.01)

(58) Field of Classification Search
CPC .... H01F 7/1805; H01F 7/1811; H01F 7/1844; H01F 2007/185; H01F 2007/1888; F02M 47/027
USPC ..... 361/160
See application file for complete search history.

(56) References Cited

U.S. PATENT DOCUMENTS

| | | | | |
|---|---|---|---|---|
| 6,367,452 | B1 * | 4/2002 | Shima | F02D 41/3845 123/457 |
| 2003/0062030 | A1 | 4/2003 | Oashi | |
| 2004/0187814 | A1 | 9/2004 | Fuwa | |
| 2005/0140351 | A1 | 6/2005 | Cagnoni et al. | |
| 2010/0263632 | A1 | 10/2010 | Miyake et al. | |
| 2016/0298565 | A1 | 10/2016 | Nagatomo et al. | |
| 2016/0356209 | A1 * | 12/2016 | DeBaker | F02D 41/0007 |
| 2018/0209366 | A1 * | 7/2018 | Kusakabe | F02D 41/20 |
| 2019/0211767 | A1 * | 7/2019 | Miyake | F02D 41/20 |

FOREIGN PATENT DOCUMENTS

| | | | |
|---|---|---|---|
| CN | 110748428 | A | 2/2020 |
| DE | 4227165 | A1 | 2/1994 |
| DE | 19963153 | A1 | 7/2001 |
| DE | 10146068 | A1 | 4/2003 |

(Continued)

OTHER PUBLICATIONS

Great Britain Intellectual Property Office, Combined Search and Examination Report under Sections 17 and 18(3) Issued in Application No. GB2000366.1, dated Jul. 10, 2020, 7 pages.

(Continued)

*Primary Examiner* — Kevin J Comber
(74) *Attorney, Agent, or Firm* — Vincent Mastrogiacomo; McCoy Russell LLP

(57) ABSTRACT

Methods and systems are provided for a solenoid actuator. In one example, a method may include adjusting a switching frequency during an activation cycle of the solenoid actuator to a lower switching frequency relative to other phases of the activation cycle.

14 Claims, 4 Drawing Sheets

(56) References Cited

FOREIGN PATENT DOCUMENTS

| | | | |
|---|---|---|---|
| EP | 1288487 | A2 | 3/2003 |
| EP | 2077383 | A2 | 7/2009 |
| EP | 2980391 | A1 | 2/2016 |
| EP | 3385528 | A1 | 10/2018 |
| JP | S62165083 | A | 7/1987 |
| WO | 2015045503 | A1 | 4/2015 |
| WO | 2019225068 | A1 | 11/2019 |

OTHER PUBLICATIONS

Great Britain Intellectual Property Office, Examination Report under Section 18(3) Issued in Application No. GB2000366.1, dated Mar. 31, 2021, 2 pages.

* cited by examiner

219-1040 METHOD FOR DRIVING INDUCTIVE PEAK AND HOLD LOADS AT REDUCED POWER

CROSS-REFERENCE TO RELATED APPLICATIONS

The present application claims priority to Great Britain Application No. 2000366.1 filed on Jan. 10, 2020. The entire contents of the above-listed application is hereby incorporated by reference for all purposes.

FIELD

The present description relates generally to actuator control in automotive vehicles and is particularly, although not exclusively, concerned with a method of controlling a solenoid actuator of a vehicle, such as a fuel injector of internal combustion engine. The present disclosure relates to actuator control for an automotive vehicle, such as a motor vehicle (e.g. car, van, truck, motorcycle etc.), industrial or agricultural vehicle (e.g. tractor, forklift, bulldozer, excavator etc.), marine vessel, aircraft or any other type of vehicle.

BACKGROUND/SUMMARY

Solenoids may be used as actuators in the field of automotive engineering. In one particular example, solenoids may be actuated to fuel an internal combustion engine to inject fuel into the cylinder. The operation of such solenoids may be known as 'peak and hold'; an initial 'peak' current is used to quickly activate the solenoid, and a lower 'hold' current is used to maintain the solenoid in its activated position. Solenoids may demand high currents to operate and, in modern digital systems, pulse width modulation (PWM) may be used to provide the appropriate current to the solenoid. The current can be altered by adjusting the duty cycle on/off ratio and the switching frequency.

There is a trend towards using higher currents in solenoid actuators so that they can provide more force, for example so that higher fuel pressures can be utilized in injectors to improve engine emissions. However, these high currents can lead to losses and heat dissipation in the switching components which control the solenoid.

It should be understood that improvements may be desirable in the field of solenoid actuator control for automotive applications.

In one example, the issues described above may be addressed by a method for controlling an actuation cycle of a solenoid actuator of a vehicle, the method, including powering the solenoid actuator using pulse-width modulation (PWM) at a first switching frequency during a first phase of the actuation cycle. The method further includes powering the solenoid actuator using PWM at a second switching frequency, less than the first switching frequency, during a second phase of the actuation cycle. The method further includes powering the solenoid actuator using PWM at a third switching frequency during a third phase of the actuation cycle. In this way, an efficiency of operating the solenoid actuator may be increased.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
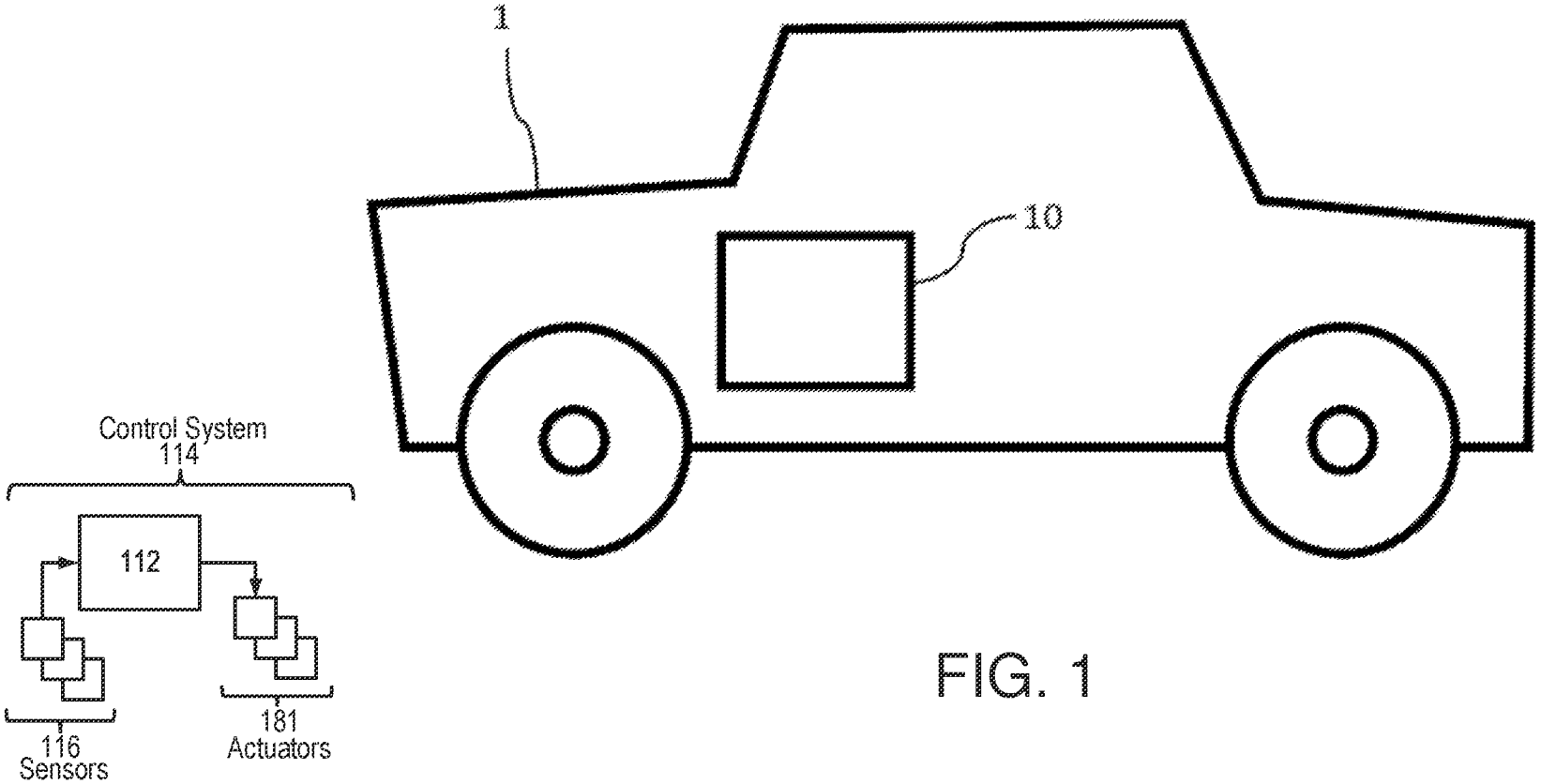
FIG. 1 shows an exemplary vehicle having an internal combustion engine.
Figure 3:
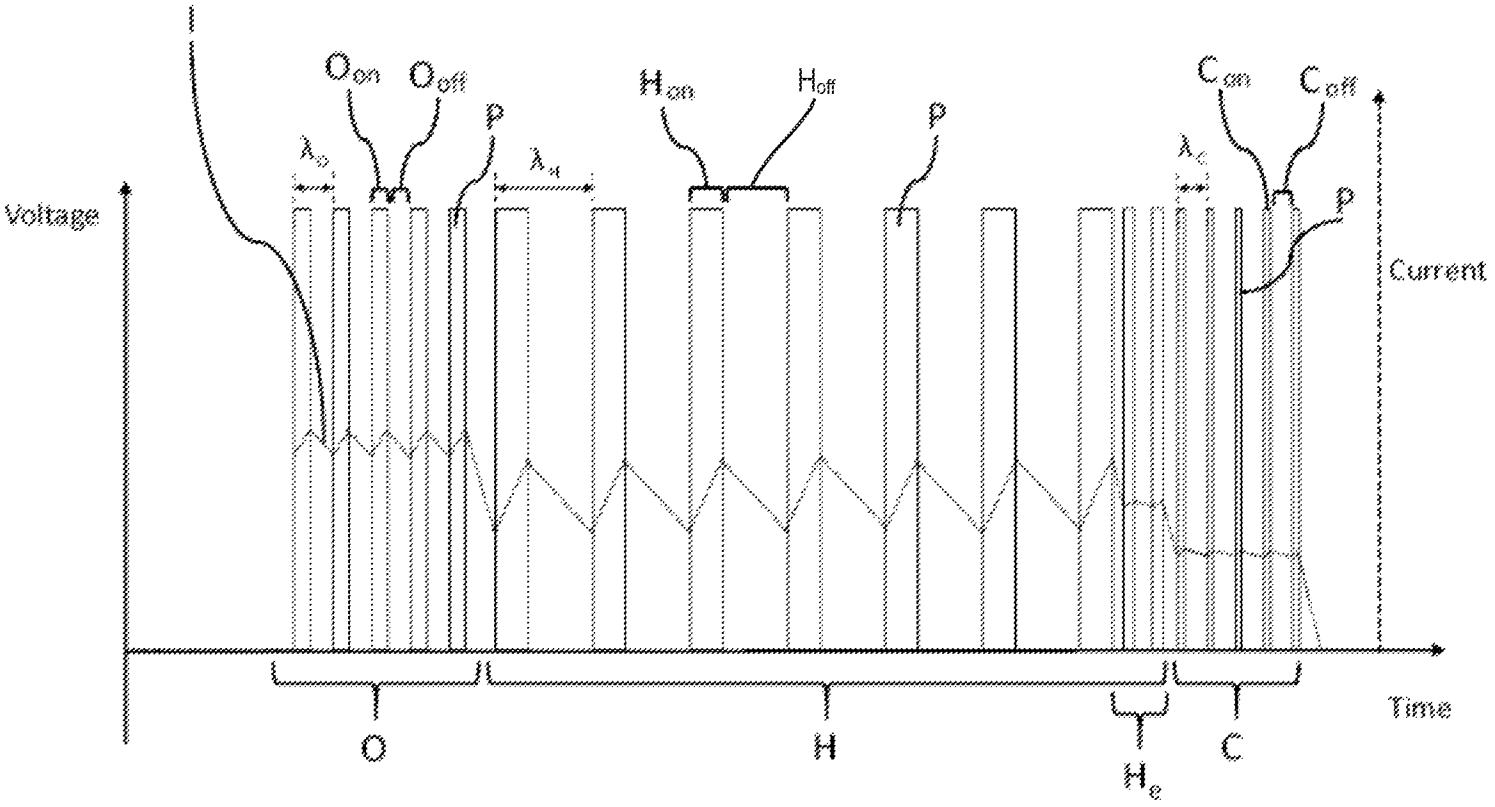
FIG. 3 shows a graph representing an exemplary method of controlling a fuel injector of an internal combustion engine during a fuel injection cycle.
Figure 4:
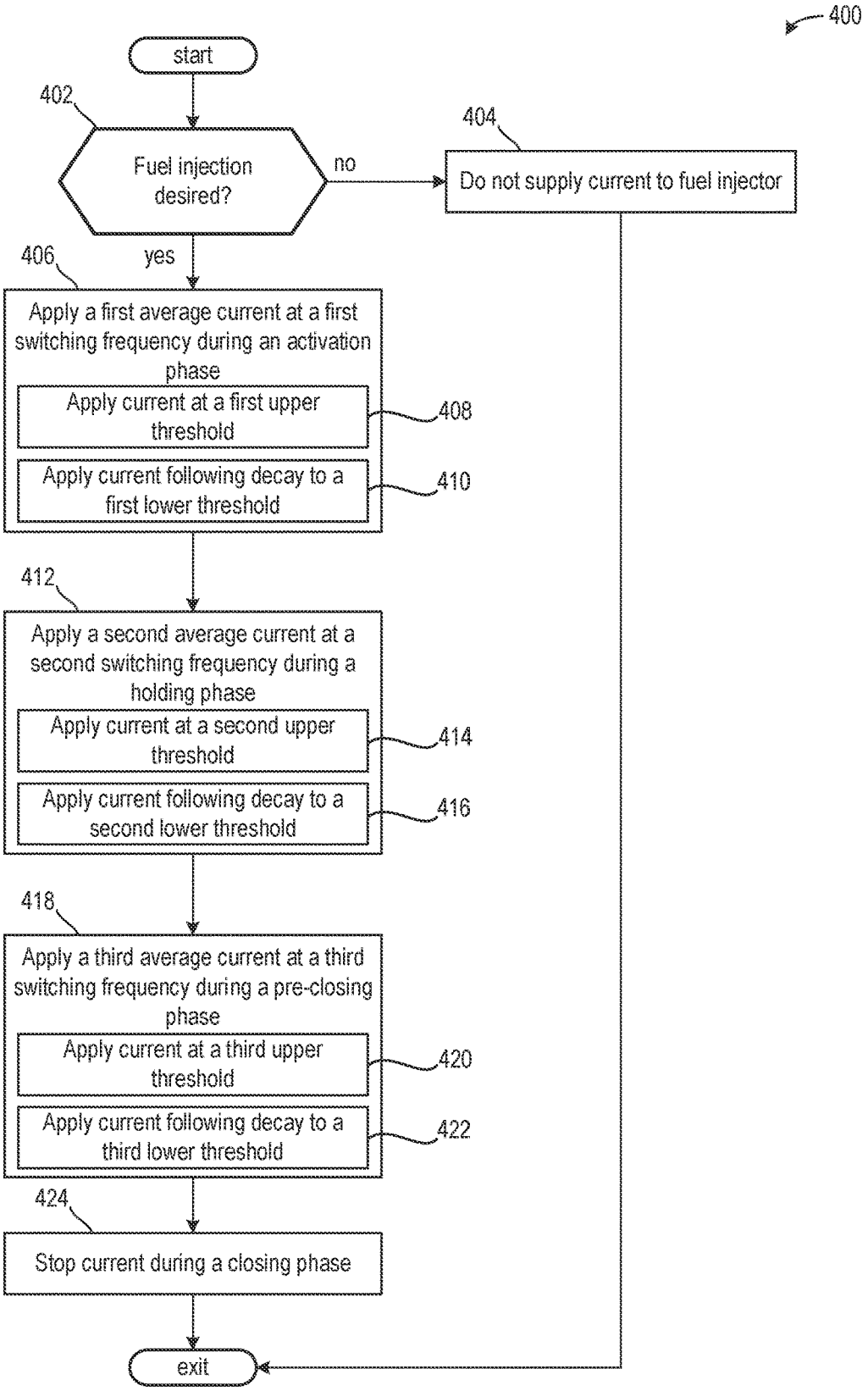
FIG. 4 shows a method for operating the fuel injector.

The following description relates to systems and methods for operating a solenoid actuator. In one example, the solenoid actuator may be a fuel injector of a power unit of a vehicle. The power unit, which may be an engine, may be arranged in a vehicle as shown in FIG. 1. The engine is shown in greater detail in FIG. 2. A graph illustrating operation of the fuel injector is shown in FIG. 3. A method for operating the fuel injector is shown in FIG. 4.

In an example embodiment, there is provided an automotive peak and hold solenoid actuation apparatus comprising a solenoid actuator configured to actuate a component within an automotive vehicle through an actuation cycle. The apparatus may further comprise a controller configured to control the actuator using pulse width modulation. The controller may comprise instructions stored on non-transitory memory thereof that when executed enable the controller to power the solenoid actuator using pulse width modulation at a first switching frequency during a first phase of the actuation cycle. The instructions may further enable the controller to power the solenoid actuator using pulse width modulation at a second switching frequency that is lower than the first switching frequency during a second phase of the actuation cycle. The instructions may further enable the controller to power the solenoid actuator using pulse width modulation at a third switching frequency during a third phase of the actuation cycle.

As another example, additionally or alternatively, there is provided a fuel injection apparatus comprising a peak and hold solenoid actuation apparatus, wherein the solenoid actuator is a fuel injector.

As another example, additionally or alternatively, there is provided an internal combustion engine including the fuel injection apparatus.

As another example, additionally or alternatively, there is provided an automotive vehicle including an internal combustion engine.

As another example, additionally or alternatively, there is provided a non-transitory computer readable medium storing a program causing a controller to execute an actuation cycle of a peak and hold solenoid actuator comprising: powering the solenoid actuator using pulse width modulation at a first switching frequency during a first phase of the actuation cycle; powering the solenoid actuator using pulse width modulation at a second switching frequency that is lower than the first switching frequency during a second phase of the actuation cycle; and powering the solenoid actuator using pulse width modulation In one example, the third switching frequency may be higher than the second switching frequency.

The third switching frequency may be the same as the first switching frequency, lower than the first switching frequency, or higher than the first switching frequency.

The first phase of the actuation cycle may be an activating phase during which the actuator is moved from an inactive to an active position. In some examples, such as where the actuator is a fuel injector or valve, the first phase may be an opening phase in which the injector or valve is opened.

The second phase of the actuation cycle may be a holding phase during which the actuator is maintained in the active position. In some examples, such as where the actuator is a fuel injector or valve, the second phase may be a holding phase in which the injector or valve is maintained open.

The third phase of the actuation cycle may be a pre-deactivating phase after which the actuator is moved from the active position to the inactive position. In some examples, such as where the actuator is a fuel injector or valve, the third phase may be a pre-closing phase after which the injector or valve is closed.

During the holding phase of the actuation cycle, the second switching frequency and/or effective current applied to the actuator may be reduced to the minimum desired to keep the actuator in the active position. It should be understood that these minima will be different for different actuators but the skilled person may be apprised of the minimum frequency/current for the actuator in question.

The aspects of the disclosure mentioned above may be for the purpose of reducing the power consumption of the solenoid actuator during the second phase of the actuation cycle.

The actuator may be a fuel injector, and the actuation cycle may be a fuel injection cycle. During the first phase of the actuation cycle, the actuator may be powered at a first effective current.

During the second phase of the actuation cycle, the actuator may be powered at a second effective current which is lower than the first effective current.

During the third phase of the actuation cycle, the actuator may be powered at a third effective current.

The third effective current may be greater than the second effective current.

The third effective current may be the same as the second effective current, lower than the second effective current, or higher than the second effective current. The third phase may demand a tighter control of current such that when the current is stopped, the decay time and opening of the solenoid is more consistent. The solenoid action may be faster if the current is pitched at the lowest level that is sufficient to keep the solenoid activated. The reduced ripple leads to more consistent solenoid closing times. If the ripple were larger (as per the second phase) then the exact current level at switch off would be variable, leading to variation in solenoid deactivating times.

In some examples, the solenoid actuator may be powered using pulse width modulation at a fourth switching frequency that is higher than the second switching frequency during an end portion of the second phase that immediately precedes the third phase. In other words, the switching frequency may be increased at the end of the second phase shortly before the third phase begins. This may improve the response time when the third phase begins, which can provide closer, more accurate control of the third phase.

The fourth switching frequency may be the same as the first, second, and/or third switching frequencies, or may be higher or lower than the first, second, and/or third switching frequencies.

After the third phase, the current applied to the solenoid actuator may be removed or reduced below an activating current threshold of the actuator, such that the actuator moves from an active position to an inactive position. This may be referred to as a closing or closed phase (i.e. a further fourth phase of the actuation cycle after the third phase).

To avoid unnecessary duplication of effort and repetition of text in the specification, certain features may be described in relation to only one or several aspects or embodiments of the invention. However, it should be understood that, where it is technically possible, features described in relation to any aspect or embodiment of the invention may also be used with any other aspect or embodiment of the invention.

Figure 2:
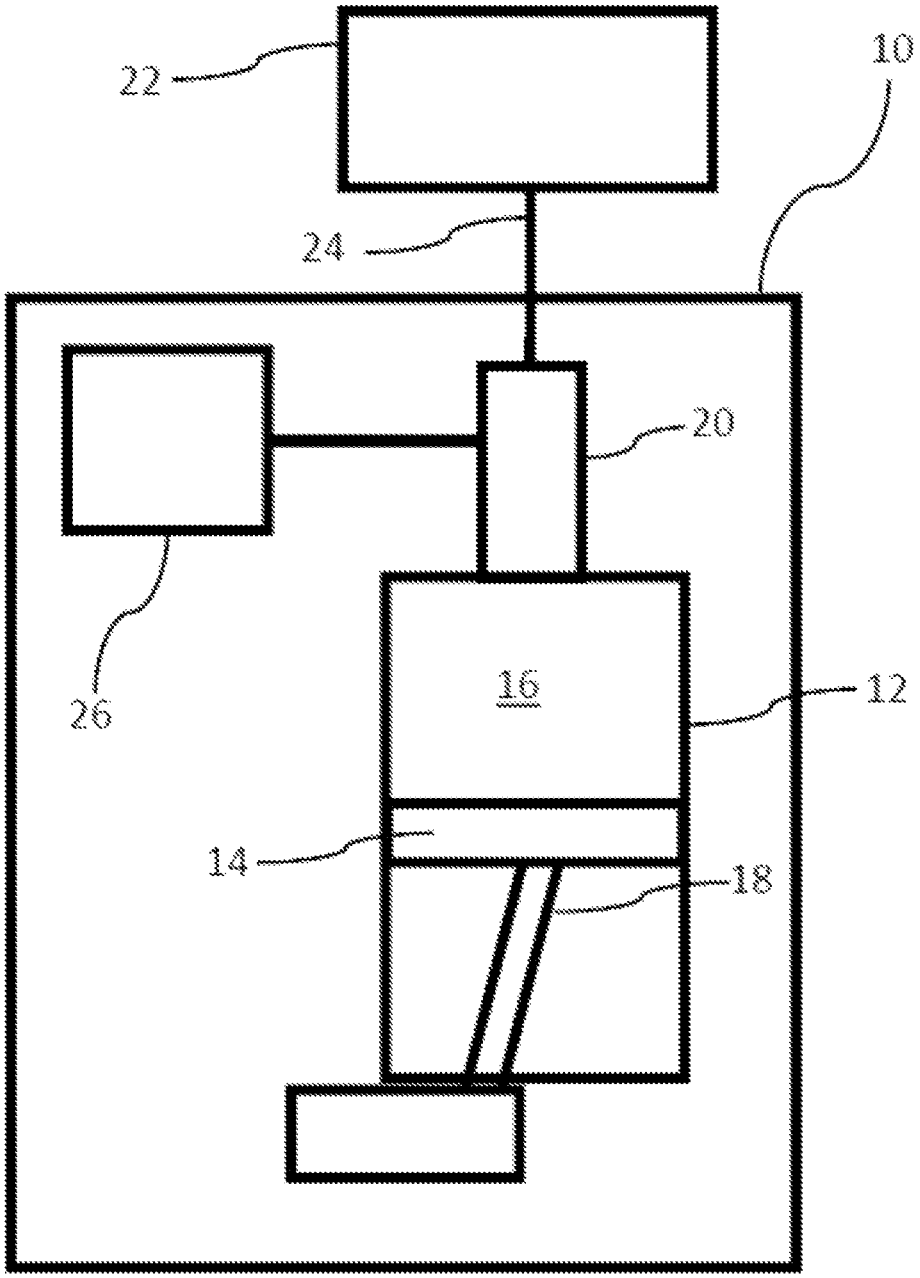
FIG. 2 shows an exemplary internal combustion engine incorporating a fuel injector.

FIGS. 1-2 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

Turning now to FIG. 1, it shows an exemplary automotive vehicle 1 comprising an internal combustion engine 10. In this example, the vehicle 1 is car, but it should be understood that the principles of this disclosure are equally applicable to other motor vehicles (e.g. car, van, truck, motorcycle etc.), industrial or agricultural vehicles (e.g. tractor, forklift, bulldozer, excavator etc.), marine vessels, aircrafts or any other type of vehicle.

The vehicle 1 comprises an internal combustion engine (or ICE) 10 which is configured to power the movement of the vehicle 1. In some examples, the internal combustion engine may be assisted by, or provided along with, an electric motor such that the vehicle 1 is a hybrid vehicle.

Vehicle 1 may further include control system 114. Control system 114 is shown receiving information from a plurality of sensors 116 (various examples of which are described herein) and sending control signals to a plurality of actuators 181 (various examples of which are described herein). As one example, actuators 181 may include a solenoid actuator of a fuel injector, as will be described below.

Controller 112 may be configured as a conventional microcomputer including a microprocessor unit, input/output ports, read-only memory, random access memory, keep alive memory, a controller area network (CAN) bus, etc. Controller 112 may be configured as a powertrain control module (PCM). The controller may be shifted between sleep and wake-up modes for additional energy efficiency. The controller may receive input data from the various sensors, process the input data, and trigger the actuators in response to the processed input data based on instruction or code programmed therein corresponding to one or more routines.

A detailed view of the exemplary ICE 10 is shown in FIG. 2. The ICE 10 comprises at least one cylinder 12 within which a piston 14 is slidably displaceable so as to define an adjustable cylinder volume 16, within which combustion occurs. The combustion in the volume 16 drives the piston 14, which provides a force output via a connecting rod and crank 18 as is well known in the art. It should be understood that the principles of the present disclosure are equally applicable to all types of ICE, such as two- and four-stroke engines, reciprocating engines, Wankel engines, etc.

In this example, the principles of the present disclosure will be described with respect to a fuel injector 20 that incorporates a peak and hold solenoid actuator. The ICE 10 comprises a fuel injector 20 which is configured to inject fuel into the cylinder volume 16 for ignition. Although in this particular illustrative example, the peak and hold solenoid actuator is a fuel injector 20, it should be understood that the principles disclosed herein may be equally applicable to other types of peak and hold solenoid actuator in automotive applications, such as high pressure fuel pumps, valves, etc.

Fuel is delivered to the fuel injector 20 from a fuel tank 22 via a fuel line 24. The fuel injector 20 is controlled by a digital controller 26. The controller 26 is configured to control the fuel injector 20, or fuel injectors if more than one is provided. The controller 26 provides a control signal to the injector 20 using pulse width modulation (PWM). The controller 26 may be provided with instructions by a non-transitory computer readable medium storing a program causing a controller to execute a fuel injection cycle as herein described.

In one example, the controller is configured to alter the PWM during the course of an injection cycle (i.e. one injection comprising: opening, holding open, and closing the fuel injector 20). The controller is configured to power the fuel injector using PWM at a first switching frequency during a first phase of the injection cycle and power the fuel injector using PWM at a second switching frequency that is different to the first switching frequency during a second phase of the injection cycle. This operating method shall now be described with reference to FIG. 3.

FIG. 3 shows a schematic graphical representation of an injection cycle of the fuel injector 20. The X axis represents time, the left Y axis represents the voltage being applied to the fuel injector and the right Y axis represents the current passing through the fuel injector. It should be understood that FIG. 3 shows only one injection cycle but the cycle may be repeated during operation of an ICE. During the operation of an ICE, successive cycles may be altered or may be the same.

As can be appreciated in FIG. 3, the PWM power is applied in discrete square-wave pulses P (shown as a solid line), which vary in duration and frequency. The voltage scale V is shown on the left hand side of the graph. Although this is shown as constant in FIG. 3, it may be higher or lower for different phases. In PWM, the digital pulses P can be carefully controlled to result in an approximated analogue current signal. The current generated by the pulses P is shown in FIG. 3 as a dotted line labelled I, having its scale on the right side of the graph. It should be understood that the width of the pulses P has been exaggerated in FIG. 3 in order to more clearly shown the principles of the control method.

The injection cycle shown in FIG. 3 comprises three phases including an opening phase O, a holding phase H, and a pre-closing phase C.

The first, opening phase O of the injection cycle is the phase during which the fuel injector is moved from a closed position to an open position in order to begin an injection of fuel into the cylinder volume 16.

The second, holding phase H of the injection cycle is the phase during which the fuel injector 20 is maintained in the open position while fuel is injected into the cylinder volume 16.

The third, pre-closing phase C of the injection cycle is the phase during which the fuel injector current is more tightly controlled, possibly at a lower average level, to cause a more consistent closing time due to reduction of ripple in comparison with the lower power PWM of phase H.

After phase C, the current applied to the solenoid actuator is removed or reduced below an activating current threshold and the injector is moved by a return spring from the open position back to the closed position to end the injection of fuel. This may be referred to as a closing or closed phase (i.e. a further fourth phase of the actuation cycle after the third phase).

With respect to FIG. 3, it will be seen that the voltage pulses P in each of the opening, holding, and pre-closing phases O, H, C have different widths (i.e. durations). Aside from the pulse voltage itself, PWM has two variables including the switching frequency of the pulses, which is set by adjusting the period, k, of the signal, and the duty cycle, which is the proportion of each period, k, that the voltage pulse P is on and off.

The same duty cycle will result in the same average current level independent of the switching frequency. However, the switching frequency determines how much 'ripple' there is in the resulting current (N.B. current ripple is the periodic rise and fall of the instant current due to the pulsing of the voltage). Lower switching frequencies have greater ripple and therefore less precise control of the actuator.

Referring to the opening phase O, the period for the PWM during this phase has a duration $\lambda_O$. During this period, the pulse is on for a duration $O_{on}$ and off for a duration of $O_{off}$. In this representative example, the duty cycle is approximately 50% on and 50% off, but may be any value up to 100%. In some examples, a high-voltage pulse may be applied immediately before, or during, the opening phase to quickly increase the current in the actuator to open it quickly. Such a peak is not shown here but it should be understood that such a modification to the control is within the scope of this disclosure.

Referring to the holding phase H, the period for the PWM during this phase has a duration $\lambda_H$, which is greater than $\lambda_O$. Accordingly, in this representative example, the switching frequency of the PWM signal in the holding phase is lower than the switching frequency of the PWM signal in the opening phase. During each period of the holding phase, the pulse is on for a duration $H_{on}$ and off for a duration of $H_{off}$. In this representative example, the duty cycle is approximately 33% on and 66% off, such that the average current is lower than the average current during the opening phase, which has a higher exemplary 50/50 duty cycle.

Referring to the pre-closing phase C, the period for the PWM during this phase has a duration $\lambda_C$. Accordingly, in this representative example, the switching frequency of the PWM signal in the pre-closing phase is higher than the switching frequency of the PWM signal in both the opening phase and the holding phase. During each period of the pre-closing phase, the pulse is on for a duration $C_{on}$ and off for a duration of $C_{off}$. In this representative example, the duty cycle is approximately 25% on and 75% off, so the average current is lower than both the opening and holding phases. The high switching frequency means that the ripple in the current is reduced, so the closing of the injector can be more accurately controlled. In particular, because the ripple amplitude is smaller, the exact current at the time the current is removed to close the injector will be more predictable.

To further improve the accuracy of control, in this example, the holding phase H may comprise a sub-phase He immediately prior to the pre-closing phase C. In this phase, the duty cycle may remain the same, such that the average current is the same as for the rest of the holding phase H, but the switching frequency is increased for a short time prior to the pre-closing phase C. Therefore, the control of the injector 20 may be more accurate before the closing of the injector and the closing time may be more consistent and repeatable. In other examples, the sub-phase He may be omitted.

In some examples according to FIG. 3, the current at some points during the ripple in phase H might be greater than the specified closing current threshold for the injector, so at the peak current in phase H, more current is being supplied than the minimum demanded to hold the injector open. Reducing the ripple in an optional sub-phase $H_e$ may allow for a more consistent current that is closer to the closing current of the injector. The average current during optional sub-phase $H_e$ might be the same as phase H, or it might be possible to reduce it for a faster closing time (per pre-closing phase C), either of which might permit more consistent injector closing times.

In other examples, the frequencies of the PWM signal in the opening, holding, and pre-closing phases may have different relationships. For example, the switching frequency in the closing phase may be the same as or lower than the switching frequency in the opening phase.

In this representative example, the duty cycle is reduced in the holding phase of the fuel injection cycle so as to provide a lower average current. In this example, the current is reduced to the minimum value demanded to hold the fuel injector open. However, it should be understood that the duty cycle and average current need not be altered as well as changing the switching frequency within the principles of the disclosure.

As can be appreciated from the output signal line I, when the switching frequency of the signal is higher, the output current varies less. The 'saw tooth' effect on the output current in the opening and closing phases is smoother than that in the holding phase. As mentioned above, this 'ripple' or 'saw tooth' effect is an artefact of the current output increasing while the pulse is on and decreasing while the pulse is off. Accordingly, the higher the switching frequency, the smoother the output current profile.

The opening and closing phases of the fuel injection cycle require the most precise control, so a significant 'saw tooth' effect is undesirable. Therefore, a higher switching frequency is applied in these phases to provide closer control of the opening and closing of the fuel injector.

However, higher switching frequencies are associated with greater losses in the electrical components producing the PWM signal, so it is desirable to keep the frequency as low as possible to reduce power consumption and thereby maximize the efficiency of the fuel injection process.

Close control of the fuel injector is less critical in the holding phase H, so a more pronounced 'saw tooth' or 'ripple' effect is acceptable. Therefore, in order to reduce overall power consumption during the fuel injection cycle, the switching frequency is reduced during the holding phase when close control is not demanded relative to the switching frequency in the opening and/or closing phases, where high frequency, close control is desired. The switching frequency, like the average current, may be reduced to the lowest acceptable value during the holding phase which maintains the fuel injector in the open position.

Accordingly, it should be understood that, by powering the fuel injector at different switching frequencies during different phases of the fuel injection cycle, a more efficient control regime can be achieved and the overall power consumption of the fuel injector and its controller can be reduced.

To avoid unnecessary duplication of effort and repetition of text in the specification, certain features are described in relation to only one or several aspects or embodiments of the disclosure. However, it is to be understood that, where it is technically possible, features described in relation to any aspect or embodiment of the disclosure may also be used with any other aspect or embodiment of the disclosure.

It will be appreciated by those skilled in the art that although the disclosure has been described by way of example, with reference to one or more exemplary examples, it is not limited to the disclosed examples and that alternative examples could be constructed without departing from the scope of the disclosure as defined by the appended claims.

Turning now to FIG. 4, it shows a method 400 for operating a solenoid actuator of a fuel injector. Instructions for executing the method 400 may be stored on non-transitory memory of the controller. The instructions may cause the controller to execute the method 400.

The method 400 begins at 402, which includes determining if a fuel injection is desired. The fuel injection may be desired is the engine is active and an accelerator pedal is depressed. If the fuel injection is not desired, then the method 400 proceeds to 404, which includes not supplying current to the fuel injector. As such, the fuel injector remains in an inactive state.

If the fuel injection is desired, then the method 400 may proceed to 406, which includes applying a first average current at a first switching frequency during an activation phase. In one example, the activation phase comprises actuating the fuel injector from a closed position to an open position, wherein the open position may fluidly couple an interior volume of the fuel injector to a combustion chamber.

Applying the first average current includes applying current at a first upper threshold at 408. The first upper threshold is based on a current higher than the first average current. The method 400 further includes applying current following a decay of the current at the first upper threshold to a first lower threshold. As illustrated in FIG. 3, a current available at a beginning of a pulse-width is greater than a current available at an end of the pulse-width. That is to say, the pulse width during the activation phase ends at the first upper threshold and the off time Goff ends at the first lower threshold prior to a subsequent pulse-width occurring. As such, the first average current is a current value between the first upper threshold and the first lower threshold. In the example of the method 400, the first switching frequency is based on an operation such that decay to the first lower threshold is relatively small such that the fuel injector is moved open during the activation phase at a desired rate.

The method 400 proceeds to 412, which includes applying a second average current at a second switching frequency during a holding phase. The holding phase further comprises applying a current at a second upper threshold at 414 and applying the current at the second upper threshold again following a decay of the current to the second lower threshold. In one example, the second upper threshold is less than or equal to the first lower threshold. The second average current may be equal to a current between the second upper threshold and the second lower threshold. In one example, the second lower threshold is based on a minimum amount of current sufficient to hold the fuel injector in the open position. In one example, the second switching frequency is less than the first switching frequency, as such, current is supplied to the solenoid actuator of the fuel injector less frequently. Thus, a second difference between the second upper threshold and the second lower threshold may be greater than a first difference between the first upper threshold and the first lower threshold. By doing this, the fuel injector may be maintained open while supplying current thereto at a lower frequency, which may increase an economy thereof while allowing a configuration of the controller to be simplified, thereby saving costs.

The method 400 proceeds to 418, which includes applying a third average current at a third switching frequency during a pre-closing phase. The pre-closing phase may further comprise applying a current at a third upper threshold at 420 and applying the current at the third upper threshold again following a decay of the current to a third lower threshold. In one example, the third upper threshold is less than the second lower threshold. Additionally or alternatively, the third switching frequency may be less than each of the first and second switching frequencies. Additionally or alternatively, the third switching frequency is greater than the second switching frequency and less than or equal to the first switching frequency. As such, a third difference between the third upper threshold and the third lower threshold may be less than the second difference. Thus, a pulse-width is applied to the solenoid actuator of the fuel injector more frequently than during the holding phase.

The method 400 may proceed to 424 which includes stopping a current supply during a closing phase. The closing phase may along a biased element, such as a spring, to more the fuel injector to the closed position without the solenoid actuator being powered.

In this way, power dissipation may be reduced while controlled opening and closing times are enhanced. Precision of a current control may be reduced during select injector operating conditions, such as during a start of a hold phase, since the current control during this period may be less important since the injector is already opened. The method of the present disclosure further allows enhanced current control for the injector closing based on knowledge of a desired injection period. That is to say, a duration of the injection period is known at the start of an injection, wherein the method may switch from a loose current control during the beginning of a hold period to a tight current control prior to a beginning of the closing event. The tight control established prior to the closing event may be tighter than previous examples due to the tight control being executed for a shorter-duration of time, thereby resulting in reduced magnetic decay relative to previous examples that maintain tight control for longer durations.

The technical effect of increasing and decreasing injector current control during specific conditions is to decrease power consumption of the injector driver while also decreasing hardware costs associated with a larger PCM, case, more heatsinking and/or active FET rectification.

An embodiment of a method for controlling an actuation cycle of a solenoid actuator of a vehicle, the method, includes powering the solenoid actuator using pulse-width modulation (PWM) at a first switching frequency during a first phase of the actuation cycle, powering the solenoid actuator using PWM at a second switching frequency, less than the first switching frequency, during a second phase of the actuation cycle, and powering the solenoid actuator using PWM at a third switching frequency during a third phase of the actuation cycle. A first example of the method further includes where the third switching frequency is higher than the second switching frequency. A second example of the method, optionally including the first example, further includes where the third switching frequency is greater than, less than, or equal to the first switching frequency. A third example of the method, optionally including one or more of the previous examples, further includes where the first phase is an activation phase, the first phase further comprising activating the solenoid actuator from an inactive position to an active position, and wherein the second phase is a holding phase, the holding phase further comprising maintaining the solenoid actuator in the active position, and wherein the third phase is a pre-deactivating phase, wherein the pre-deactivating phase further comprises moving the solenoid actuator from the active position to the inactive position. A fourth example of the method, optionally including one or more of the previous examples, further includes where the second switching frequency is equal to a minimum current configured to maintain the solenoid actuator in the active position. A fifth example of the method, optionally including one or more of the previous examples, further includes where the solenoid actuator is a fuel injector and wherein the actuation cycle is a fuel injection cycle. A sixth example of the method, optionally including one or more of the previous examples, further includes where powering during the first phase further comprises a first effective current, and wherein powering during the second phase further comprises a second effective current, which is less than the first effective current, and wherein powering during the third phase comprising a third effective current greater than the second effective current. A seventh example of the method, optionally including one or more of the previous examples, further includes where powering the solenoid actuator at a fourth switching frequency between the second phase and the third phase, wherein the fourth switching frequency is greater than the second switching frequency.

An embodiment of a system, comprises an engine comprising a fuel injector and a controller comprising instructions stored on non-transitory memory thereof that when executed enable the controller to power a solenoid actuator of the fuel injector at a first switching frequency during an opening phase of a fuel injection cycle, power the solenoid actuator of the fuel injector at a second switching frequency during a hold phase of the fuel injection cycle following the opening phase, wherein the second switching frequency is less than the first switching frequency, and power the solenoid actuator of the fuel injector at a third switching frequency during a pre-closing phase of the fuel injection cycle, wherein the third switching frequency is greater than the second switching frequency. A first example of the system further includes where the third switching frequency is greater than or equal to the first switching frequency. A second example of the system, optionally including the first example, further includes where the instructions further enable the controller to power the solenoid actuator of the fuel injector at a fourth switching frequency during a holding sub-phase, wherein the holding sub-phase occurs between the holding phase and the pre-closing phase, and wherein the fourth switching frequency is greater than the second switching frequency. A third example of the system, optionally including one or more of the previous examples, further includes where a current provided during the holding sub-phase is equal to or less than an average current provided during the holding phase. A fourth example of the system, optionally including one or more of the previous examples, further includes where the instructions further enable the controller to stop powering the solenoid actuator during a closing phase following the pre-closing phase. A fifth example of the system, optionally including one or more of the previous examples, further includes where the switching frequency determines a ripple, and wherein the ripple corresponds to an availability of current to the solenoid actuator. A sixth example of the system, optionally including one or more of the previous examples, further includes where the second switching frequency is based on a lowest average current used to hold the fuel injector open.

An embodiment of a system, comprises an engine comprising a fuel injector and a controller comprising instructions stored on non-transitory memory thereof that when executed enable the controller to power a solenoid actuator of the fuel injector at a first switching frequency during an opening phase of a fuel injection cycle, power the solenoid actuator of the fuel injector at a second switching frequency during a hold phase of the fuel injection cycle following the opening phase, wherein the second switching frequency is less than the first switching frequency, wherein the second switching frequency is based on a lower threshold current configured to maintain the fuel injector open, and power the solenoid actuator of the fuel injector at a third switching frequency during a pre-closing phase of the fuel injection cycle, wherein the third switching frequency is greater than the second switching frequency. A first example of the system further includes where the solenoid actuator is powered via pulse-width modulation. A second example of the system optionally including the first example, further includes where a decay of a current provided to the solenoid actuator is greater during the second switching frequency than in both of the first switching frequency and the third switching frequency. A third example of the system, optionally including one or more of the previous examples, further includes where the instructions further enable the controller to power the solenoid actuator of the fuel injector at a fourth switching frequency during a holding sub-phase, wherein the holding sub-phase occurs between the holding phase and the pre-closing phase, and wherein the fourth switching frequency is greater than the second switching frequency. A fourth example of the system, optionally including one or more of the previous examples, further includes where an average current provided to the solenoid actuator during the holding phase is equal to an average current provided to the solenoid actuator during the holding sub-phase.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types including stationary engines. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for controlling an actuation cycle of a solenoid actuator of a vehicle, the method comprising:

powering the solenoid actuator using pulse-width modulation (PWM) at a first switching frequency during a first phase of the actuation cycle;

powering the solenoid actuator using PWM at a second switching frequency, less than the first switching frequency, during a second phase of the actuation cycle;

powering the solenoid actuator using PWM at a third switching frequency during a third phase of the actuation cycle; and powering the solenoid actuator at a fourth switching frequency between the second phase and the third phase, wherein the fourth switching frequency is greater than the second switching frequency;

wherein the first phase is an activation phase, the first phase further comprising activating the solenoid actuator from an inactive position to an active position, wherein the second phase is a holding phase, the holding phase further comprising maintaining the solenoid actuator in the active position, and wherein the third phase is a pre-deactivating phase, the pre-deactivating phase further comprising moving the solenoid actuator from the active position to the inactive position; and wherein powering during the first phase further comprises a first effective current, wherein powering during the second phase further comprises a second effective current, which is less than the first effective current, and wherein powering during the third phase comprises a third effective current greater than the second effective current.

2. The method of claim 1, wherein the third switching frequency is higher than the second switching frequency.

3. The method of claim 1, wherein the third switching frequency is greater than, less than, or equal to the first switching frequency.

4. The method of claim 1, wherein the second switching frequency is equal to a minimum current configured to maintain the solenoid actuator in the active position.

5. The method of claim 1, wherein the solenoid actuator is a fuel injector and wherein the actuation cycle is a fuel injection cycle.

6. A system, comprising:

an engine comprising a fuel injector; and a controller comprising instructions stored on non-transitory memory thereof that when executed enable the controller to:

power a solenoid actuator of the fuel injector at a first switching frequency during an opening phase of a fuel injection cycle;

power the solenoid actuator of the fuel injector at a second switching frequency during a hold phase of the fuel injection cycle following the opening phase, wherein the second switching frequency is less than the first switching frequency;

power the solenoid actuator of the fuel injector at a third switching frequency during a pre-closing phase of the fuel injection cycle, wherein the third switching frequency is greater than the second switching frequency; and power the solenoid using pulse width modulation at the first, second, and third switching frequencies;

wherein powering during the opening phase further comprises a first effective current, wherein powering during the hold phase further comprises a second effective current, which is less than the first effective current, and wherein powering during the pre-closing phase comprises a third effective current greater than the second effective current; and wherein the instructions further enable the controller to power the solenoid actuator of the fuel injector at a fourth switching frequency during a holding sub-phase, wherein the holding sub-phase occurs between the holding phase and the pre-closing phase, and wherein the fourth switching frequency is greater than the second switching frequency.

7. The system of claim 6, wherein the third switching frequency is greater than or equal to the first switching frequency.

8. The system of claim 6, wherein a current provided during the holding sub-phase is equal to or less than an average current provided during the holding phase.

9. The system of claim 6, wherein the instructions further enable the controller to stop powering the solenoid actuator during a closing phase following the pre-closing phase.

10. The system of claim 6, wherein the switching frequencies determine a ripple, and wherein the ripple corresponds to an availability of current to the solenoid actuator.

11. The system of claim 6, wherein the second switching frequency is based on a lowest average current used to hold the fuel injector open.

12. A system, comprising:

an engine comprising a fuel injector; and a controller comprising instructions stored on non-transitory memory thereof that when executed enable the controller to:

power a solenoid actuator of the fuel injector at a first switching frequency during an opening phase of a fuel injection cycle;

power the solenoid actuator of the fuel injector at a second switching frequency during a hold phase of the fuel injection cycle following the opening phase, wherein the second switching frequency is less than the first switching frequency, and wherein the second switching frequency is based on a lower threshold current configured to maintain the fuel injector open;

power the solenoid actuator of the fuel injector at a third switching frequency during a pre-closing phase of the fuel injection cycle, wherein the third switching frequency is greater than the second switching frequency; and power the solenoid actuator using pulse width modulation at the first, second, and third switching frequencies;

wherein powering during the opening phase further comprises a first effective current, wherein powering during the hold phase further comprises a second effective current, which is less than the first effective current, and wherein powering during the pre-closing phase comprises a third effective current greater than the second effective current;

wherein the instructions further enable the controller to power the solenoid actuator of the fuel injector at a fourth switching frequency during a holding sub-phase, wherein the holding sub-phase occurs between the holding phase and the pre-closing phase, and wherein the fourth switching frequency is greater than the second switching frequency.

13. The system of claim 12, wherein a decay of a current provided to the solenoid actuator is greater during the second switching frequency than in both of the first switching frequency and the third switching frequency.

14. The system of claim 12, wherein an average current provided to the solenoid actuator during the holding phase is equal to an average current provided to the solenoid actuator during the holding sub-phase.

* * * * *